United States Patent [19]

Albright

[11] 4,161,737

[45] Jul. 17, 1979

[54] HELICAL ANTENNA

[76] Inventor: Eugene A. Albright, 1742 W. Rose, Phoenix, Ariz. 85015

[21] Appl. No.: 838,484

[22] Filed: Oct. 3, 1977

[51] Int. Cl.[2] ..... H01Q 1/36

[52] U.S. Cl. ..... 343/749; 343/895

[58] Field of Search ..... 343/749, 750, 895, 711, 343/713

[56] References Cited

U.S. PATENT DOCUMENTS

| | | | |
|---|---|---|---|
| 2,755,469 | 7/1956 | Etheridge | 343/895 |
| 2,938,210 | 5/1960 | Harris | 343/895 |
| 2,958,081 | 10/1960 | Dyson | 343/895 |
| 2,966,679 | 12/1960 | Harris | 343/895 |
| 3,445,849 | 5/1969 | Sanford | 343/749 |

*Primary Examiner*—Eli Lieberman

*Attorney, Agent, or Firm*—LaValle D. Ptak

[57] ABSTRACT

A stepped, tapered helical antenna has tightly wound loading coils between each of the different helical sections, and the loading coils are wound in a stepped, tapered mathematical progression. Improved operating characteristics are obtained by embedding the upper section of the antenna winding in a permanently magnetized dielectric material and adding parasitic copper foil windings between the turns of the helical windings of the antenna to increase its radiating surface and broaden its band of response.

8 Claims, 6 Drawing Figures

HELICAL ANTENNA

RELATED APPLICATIONS

Application Ser. No. 739,429, filed on Nov. 8, 1976 (now abandoned) and application Ser. No. 903,700, filed on May 8, 1978 are related to this application.

BACKGROUND OF THE INVENTION

Radio antennas are widely used in conjunction with various types of radio frequency transmitters and receivers. A variety of shapes and electrical configurations are employed, ranging from end-fed antennas which are substantially linear conductive rods of various lengths, having specific relationships to the wave lengths of the frequencies of the signals transmitted from or received by such antennas, to complex arrays of components. End-fed antennas are commonly used in mobile communications applications for radio telephone, ham radio, and CB (citizens band) applications. Because end-fed conductive rods (more commonly referred to as "whip" antennas) necessarily are quite long for the frequencies employed in mobile radio communications, attempts have been made to compact the overall antenna length at given wave lengths of signal frequencies by utilizing helical antennas or composite antennas involving combinations of various antenna shapes and configurations, such as complex lens antennas, multiple tuned antennas, dipoles and the like.

A problem which has been encountered in the past with the use of helical antennas in place of the more simple whip antennas is that short helical antennas, in theory and in practice, have exhibited considerably reduced efficiency compared with a conventional end-fed whip antenna. For example, for an antenna operating at the CB center frequency of 27 MHz, a three foot base-loaded helical antenna has 20% of the efficiency of a one-hundred two-inch whip antenna operating at that frequency. As a consequence, helical antennas have not proved popular with mobile communications users who are interested in obtaining maximum efficiency from their equipment. Thus in the past, mobile communications users, such as CB users, had to reach a compromise between antenna length (that is the long whip antennas) and lowered efficiency if a short antenna was desired or necessary.

In order to provide sufficient power, either for transmission or reception, for conventional antennas in any given situation, it often is necessary to have extremely large antenna structures or antenna towers to obtain the desired operating characteristics of the transmitter or receiver. Such structures are costly to build; and because of the substantial space they require or the substantial height to which they must reach, result in expensive, cumbersome and unattractive installations. For example, two-way radio antennas, such as are used for ham radio, CB radio base stations, and the like, require large unsightly installations if any reasonable range is to be obtained from the radio system using the antenna.

Therefore it is desirable to provide radio transmitting and receiving antennas of reduced length or height from those conventionally used and which exhibit little or no loss in efficiency when compared with long whip or end-fed rod antennas of the prior art.

SUMMARY OF THE INVENTION

Accordingly, it is an object of this invention to provide an improved antenna structure.

It is another object of this invention to provide an improved helical antenna structure.

It is an additional object of this invention to provide an improved stepped helical antenna structure.

It is yet another object of this invention to provide an antenna structure using stepped, tapered helical windings and stepped, tapered loading coils.

It is a further object of this invention to provide a helical antenna with parasitic secondary loading windings.

It is still another object of this invention to provide an antenna structure using stepped, tapered helical windings and stepped, tapered helical parasitic secondary windings to improve its efficiency.

In accordance with a preferred embodiment of this invention, an antenna is constructed on an elongated dielectric support member on which is wound a helical stepped, tapered conductive antenna winding. This winding comprises several helical winding sections each of a narrower pitch than the next lower section progressing from the bottom of the antenna to the top. In addition, each of the sections are interconnected by tightly wound step, tapered loading coils wound according to a mathematical progression.

In a more specific embodiment, secondary parasitic windings are wound on the dielectric support member in the spaces between adjacent turns of the helical conductive antenna winding and are electrically isolated from the antenna winding to provide an increased radiation surface from the antenna.

DETAILED DESCRIPTION OF THE PREFERRED EMBODIMENT

Figure 1:
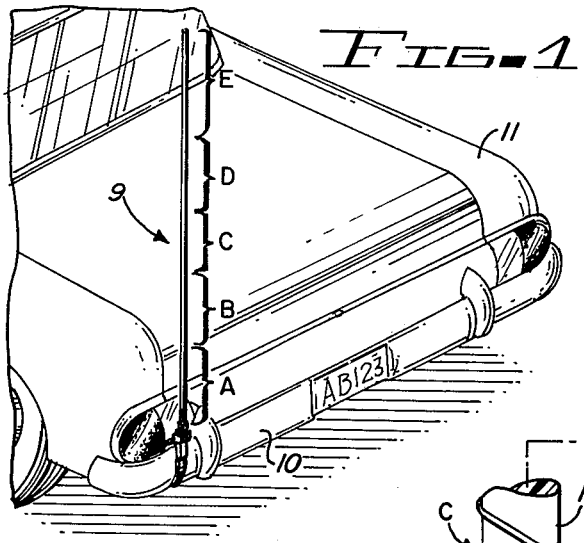
FIG. 1 is an installation of an antenna in accordance with a preferred embodiment of this invention.
Figure 3:
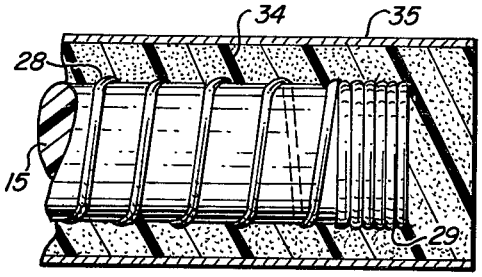
FIG. 3 shows additional details of the construction of the end portion of the antenna of FIG. 1.

In the drawings, the same reference numbers are used throughout the different figures to designate the same or similar components. In FIG. 1 there is illustrated an antenna 9 constructed in accordance with a preferred embodiment of the invention and mounted on the rear bumper 10 of an automobile 11. The antenna 9 is shown as having five sections, A, B, C, D and E, respectively, which are nearly the same length but which differ in length somewhat from section to section. Although the antenna shown in FIG. 1 is illustrated as being mounted on the bumper 10 of the automobile, it is common practice, particularly for a citizens band (CB) radio antenna to mount the antenna on the trunk lid of the automobile or on its roof for optimum performance.

Figure 2:
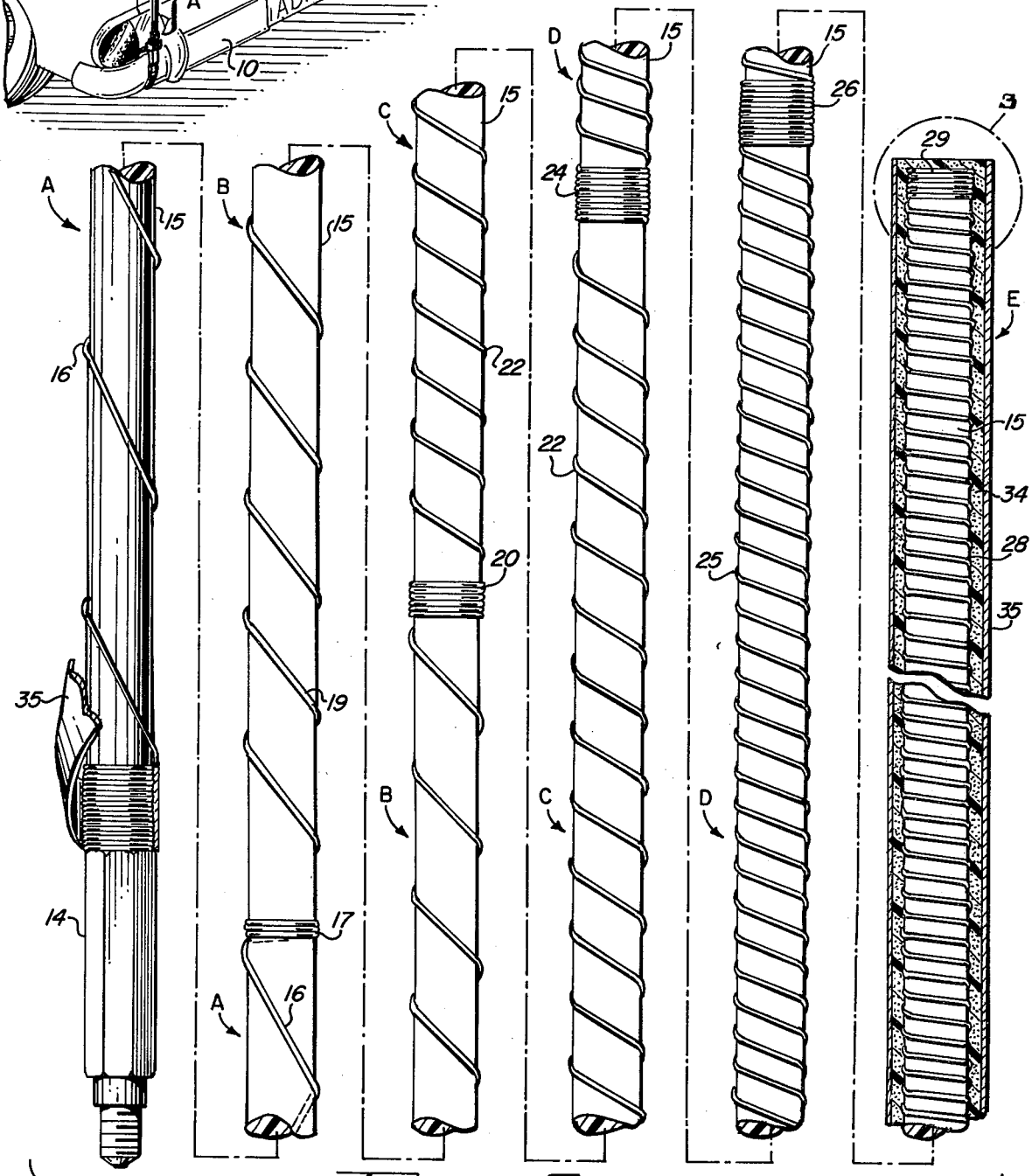
FIG. 2 shows the details of the construction of the antenna of FIG. 1.

The antenna of FIG. 1 is shown in exploded detail in FIG. 2, and each of the sections of the antenna 9 identified by the letters A through E of FIG. 1 are similarly identified in FIG. 2. This antenna is a quarterwave antenna which is designed to equal or better the performance of a conventional whip end-fed antenna with an antenna height less than one-half the length of a whip antenna for operation at the same frequency.

The basic structural support for the antenna is provided by a dielectric rod 15 attached to a conductive base stub 14 which is inserted into the terminal to which signals are applied and from which signals are obtained by the radio transceivers used in conjunction with the antenna. The dielectric rod 15 may be either a solid rod, as shown in FIG. 2, or it may be a hollow tube, provided sufficient strength can be realized from a hollow tube in the applications with which the antenna is to be used. The particular material which is used for the rod is not important and fiber glass resins have been found to be highly suitable for this application.

By winding the antenna winding for the antenna on the rod 15 in a stepped, tapered helical winding, with stepped, tapered loading coils interspersed between each of the different steps of the helical winding, a total length or height of the antenna of four-ninths the length of a conventional whip antenna for the same frequency can be realized. This is accomplished in the antenna shown in FIG. 2 by winding the lowermost section A of the antenna with a relatively wide spacing between the adjacent turns of the helical winding 16 on this section of the antenna. This section then terminates in a loading coil 17 which is shown as comprising three turns of tightly wound wire. From the loading coil 17 the wire then is wound in a more closely wound helix 19 in the section B which terminates in another loading coil 20, comprised of six turns of tightly wound wire. The next section C comprises a helical winding 22 which is more tightly wound than the winding 19, and this winding terminates in a loading coil 24 comprised of nine turns of closely wound wire. The section D then continues the winding in a more tightly wound helix 25 than the helix 22, and this section similarly terminates in a loading coil 26 comprised of twelve turns of tightly wound or closely wound wire. The uppermost or last section E of the antenna also comprises an open helix winding 27 which is more closely wound than the winding 25 in the section D. This section terminates in a top loading coil 29, the number of turns of which is relatively small (three to nine generally) and which is specifically determined by the loading required for the particular antenna frequency for which the antenna is designed.

In the antenna shown in FIG. 2, the stepped, tapered pattern of the helical windings in the sections A through D is a standard stepped taper employed in the prior art, except for the provision of the loading coils 17, 20, 24 and 26 between each of the different steps or different pitched helix windings for the different sections. In addition, the antenna of FIG. 2 differs from conventional stepped, tapered helical antennas in the uppermost section E by the use of the open helix winding 28 with a relatively low number of turns in the end loading coil 29.

In the design of the antenna shown in FIG. 2, the different lengths of the sections A, B, C, D and E were empirically determined. The overall length of the antenna also was empirically determined by experimentation, and it has been found that at any desired frequency the length required for the antenna of FIGS. 1 adn 2 is four-ninths of the length of a whip antenna designed for the same frequency. For example, the wave length of a signal at 27 MHz is 36 feet. Thus, a quarter-wave whip antenna operating at this frequency is nine feet in length, and four-ninths of this length equals four feet, which is the length selected for the antenna shown in FIGS. 1 and 2.

It then has been determined, again empirically, that the amount of wire in the helix winding for each of the sections A through E including the stepped, tapered coils is approximately three-fourths of the length of a wave of the signal at the operating frequency for which the antenna is to be used. Thus, for the 27 MHz example under consideration, the length of wire to be used in the helical windings is three-fourths of 36 feet or 27 feet of wire total. In actual practice, the total length of wire is somewhat less than this and is determined empirically by winding the top one-fourth of the dielectric rod 15 (upper section E) using one-half of the available wire (thus comprising a one-eighth wave length) and terminating the winding 28 for this section with a close wound (that is, turn-on-turn touching) loading coil 29. For a three-eighths inch diameter dielectric support 15, it has been found that the turn-to-turn spacing of the helix 28 for an antenna designed to operate at a 27 MHz center frequency is approximately one-eighth inch. The matching of the loading coil 29 to the helical winding 28 on the section E for a one-eighth wave length antenna is accomplished by utilizing a grid-dip meter (tuned to the resonant frequency) and an antenna impedance meter, after first choosing the impedance at which the antenna is designed to operate. The loading coil windings then are determined in accordance with the optimum readings of these two meters. For an antenna constructed in accordance with the example under consideration, the loading coil 29 comprises six turns of wire.

After the top one-fourth of the antenna, consisting of the section E and comprising one-eighth wave length of the available wire, has been completed, the balance of the antenna is wound in accordance with the pattern illustrated in FIG. 2, distributing the wire remaining as evenly as possible over the other four sections of the stepped helical winding. An arithmetical progression is used for the winding sections where the turn-to-turn spacing of each of the helical sections, progressing downwardly from the top of the antenna to the bottom, is double the spacing for the section immediately above. For example, when one-eighth inch spacing is used for the helix 28 of the section E, a one-fourth inch turn-to-turn spacing is used for the helix 25 of the section D. Similarly, and continuing the progression, the turn-to-turn spacing of the helix 22 of section C is one-half inch, the spacing of the helix 19 of section B is one inch and finally, the turn-to-turn spacing of the windings of the helix 16 of the section A is two inches. This is a typical arithmetical progression which is used for stepped, tapered helical antenna windings, but other progressions could be employed. The total length of wire which is available for the stepped, tapered helical windings 16, 19, 22 and 25 and the tightly wound loading coils 17, 20, 24 and 26 is equal to the one-eighth wave length wire remaining after the winding 28 has been formed on the rod 15.

It also should be noted at this time that a stepped, tapered arithmetical progression is employed, increasing from the bottom to the top of the antenna, for the loading coils 17, 20, 24 and 26. As explained previously, the progression which is illustrated in FIG. 2 is a three-six-nine-twelve progression for these loading coils. Other progressions could be used with comparable results, such as a four-eight-twelve-sixteen progression. The ideal progression or ratio of these different loading coils can be determined empirically for any given antenna, and the loading coils are used to provide as near as possible linear current loading of the antenna when it is employed as a base-fed antenna by applying signals to the stub or terminal 16.

Figure 5:
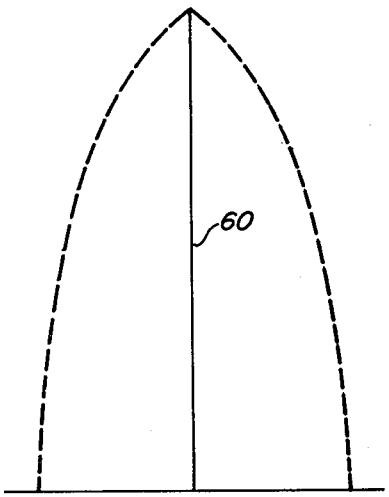
FIGS. 5 and 6 show waveforms useful in explaining the operation of the antennas shown in FIGS. 1 through 4.
Figure 6:
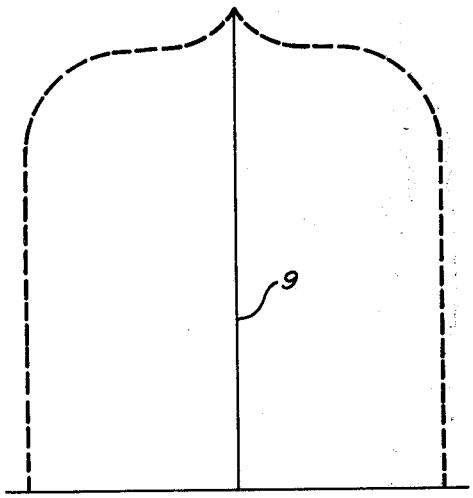

Without the loading coils most of the current return to ground for a base-loaded helical antenna occurs in the first foot or so of the antenna, whereas the antenna constructed in accordance with FIG. 2 causes the current return to ground to come primarily from near the top of the antenna in contrast to conventional antennas. This is illustrated in the patterns shown in FIGS. 5 and 6, where FIG. 5 is representative of a vertical whip antenna 60 and FIG. 6 is representative of the antenna 9 which has been described. A whip antenna 60 shows a current return to ground pattern which is more or less conical in shape, whereas the antenna 9 wound in accordance with the winding pattern of FIG. 2 has a uniform (that is nearly cylindrical) pattern of current return to ground. Since the field strength of an antenna is a direct function of the current distribution on the antenna, it is readily apparent that a pattern which approximates that shown in FIG. 6 is highly desirable for maximum antenna efficiency. This pattern is caused by the use of the stepped, tapered loading coils which terminate each of the different sections of the helical winding as that winding progresses from the bottom to the top of the antenna. More and more inductance is needed in these loading coils as they are placed farther from the input end of the coil in order to balance the capacitive reactance of the antenna which decreases along its length. The actual amount of inductance at each of these windings is determined by the placement of the coil on the antenna along its length, and these loading windings or coils can be utilized to balance the antenna loading anywhere on the antenna.

Tuning of an antenna built in accordance with the structure shown in FIG. 2 is accomplished by making the stepped, tapered loading coils 17, 20, 24 and 26 to cause the antenna sections to be slightly less than resonance at each point. The antenna then is brought into resonance by adjusting the number of turns of the coil 29 which comprises the top loading coil for the antenna.

In an actual 27 MHz antenna constructed in accordance with the foregoing description on a four foot dielectric rod, three-eighths inch in diameter, number 22 wire was used for the helical winding sections and the loading coils in the pattern shown in FIG. 2. This antenna provided a radiation resistance of 51 ohms, with an actual resistance of about 5 ohms at the 27 MHz center resonant frequency. Since the efficiency of an antenna is determined by the ratio of radiation resistance to the actual resistance, it can be seen that a highly efficient antenna resulted. In fact the efficiency of this antenna equals or exceeds the efficiency of a conventional 102" whip antenna for the same frequency of operation. This is in contrast to conventional helical top-loaded antennas of comparable length which have a substantially reduced fraction of the efficiency of a full quarter-wave whip antenna.

It also has been found that when the upper one-eighth wave length section of the antenna (that is, section E, which includes the winding 28 and the loading coil 29) is embedded in a permanently magnetized dielectric 34, the improved characteristics of the antennas described in Applicant's co-pending application, Ser. No. 739,429 filed Nov. 8, 1976, also are obtained with the antenna shown in FIG. 2 in addition to the characteristics which result from the winding pattern described above. Reference should be made to the disclosure of this co-pending application for a description of these improved characteristics, and the disclosure of that application is incorporated herein by reference. In addition, to protect the antenna from the elements, a thermoplastic sleeve 35 is used to encase the entire antenna and is placed over the helical antenna windings and loading coils either by winding a tape around the antenna (as shown on section A of FIG. 2) or by heat shrinking in plastic sleeve over the entire antenna. The manner in which the sleeve 35 is applied to the antenna is not important. Neither does the sleeve 35 impart any operating characteristics to the antenna other than to reduce the possibility of damage to the antenna windings from objects striking the antenna and also serves to protect the windings from the elements when the antenna is used in an outdoor application such as illustrated in FIG. 1.

Figure 4:
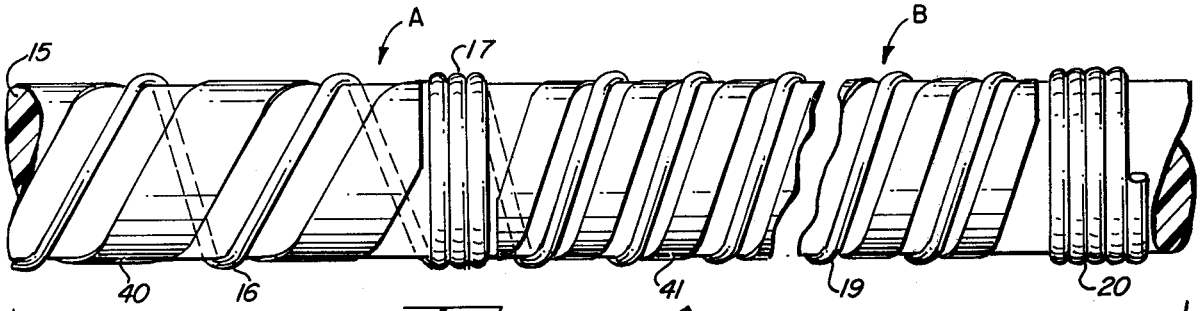
FIG. 4 shows a section of the antenna of FIG. 2 modified in accordance with a second embodiment of the invention.

In addition to the improved operating characteristics which result from the antenna construction described above, it also has been discovered that the utilization of parasitic secondary windings having lengths equal to the lengths of the sections of the windings used in the antenna shown in FIG. 2 can be added to the antenna to improve its efficiency or radiation characteristics. Such an addition to the embodiment shown in FIG. 2 is illustrated in FIG. 4, which shows a portion of sections A and B of the antenna of FIG. 2 where they are joined by the loading coil 17. Narrow strips of copper foil or other suitable conductive material are wound in the spaces between the windings 16 and 19 (and also between the windings 22, 25 and 28 of the antenna shown in FIG. 2) to act as parasitic secondary transformer windings on the antenna. Two such strips 40 and 41 are shown in FIG. 4 wound between the windings 16 and 19, respectively. Similar strips (not shown) are wound between the windings 22, 25 and 28 of an antenna such as the one shown in FIG. 2.

The strips 40 and 41 (and the other strips used with the antenna) are one-half the width of the spacing between adjacent turns with which they are used. In the specific example given, this means that with the two inch spacing between the turns of the winding 16, the strip 40 is one inch wide. Similarly, the strip 41 is one-half inch wide since the turn-to-turn spacing of the helical winding 19 is one inch. As is shown in FIG. 4, the strips 40 and 41 terminate short of the coils 17 and 20, so that there is no electrical connection between the strips 40 and 41 and the wire comprising the helical antenna coils and the loading coils constituting the primary radiating element of the antenna.

With an antenna of the type described above, the addition of the parasitic windings in the form of copper foil between all of the spacings of the helical windings of the antenna provides approximately 30 square inches of additional radiating surface for the antenna. These strips do not detune the antenna since they are equal in length to the wave lengths of the windings of the antenna, as is readily apparent since the spacings between the helical windings 16, 19, 22, 25 and 28 are the same length as the windings themselves.

The mathematical development and theory of why these parasitic secondary windings improve the antenna is not known to the inventor; but with an antenna constructed as described above, a three db gain over the same antenna without the parasitic secondary windings has been obtained. While this in itself is significant, the main advantage of the parasitic windings 40, 41 (and similar windings on the remainder of the antenna) is that a broad banding of the antenna response characteristics has been obtained in contrast to conventional helical antennas which are inherently narrow band in operation. Excellent response over a one megahertz bandwidth has been obtained from an antenna built in accordance with the embodiment of FIG. 4.

The foregoing description of specific preferred embodiments of the invention has been used for the purposes of illustration and is not intended to be limiting of the inventive concepts which are disclosed. Various modifications and changes will occur to those skilled in the art without departing from the scope of the invention as defined in the appended claims.

I claim:

1. An antenna including in combination:

an elongated support member for supporting an antenna coil thereon;

a helical stepped, tapered conductive antenna winding on said support member comprising at least first, second and third conductively interconnected winding sections each having a different pitch in a stepped progression from the first to the third section, and first and second tightly wound loading coils located respectively, between the first and second sections, and the second and third sections of said winding, said first and second loading coils comprising stepped, tapered windings, respectively.

2. The combination according to claim 1 wherein the number of windings of said loading coils is in accordance with a mathematical progression.

3. The combination according to claim 2 wherein the mathematical progression of said loading coils increases in a predetermined manner from the loading coil nearest the signal input to said antenna to the loading coil farthest from the signal input to said antenna.

4. The combination according to claim 1 further including parasitic conductive windings on said support member between the turns of at least the section of said helical antenna winding farthest from the signal input.

5. The combination according to claim 4 wherein separate parasitic windings are placed between the turns of the antenna windings in each different section thereof.

6. The combination according to claim 5 wherein said parasitic windings are foil sections having a width which is approximately one-half the distance between adjacent turns of the helical antenna winding sections between which they are wound.

7. The combination according to claim 1 wherein said antenna is a quarter-wave base-fed antenna and wherein the top section of said helical antenna winding is comprised of one-eighth inch spaced helical turns constructed to comprise a one-eighth wave antenna at the frequency at which said antenna is to operate, so that the remainder of said stepped, tapered helical conductive antenna winding sections comprise a one-eighth wave antenna balance required for the total quarter wave antenna comprised of all said winding sections.

8. The combination according to claim 1 wherein the total length of wire utilized for said antenna winding and said loading coils is substantially three-fourths the length of the wave length of the signal at the operating frequency and the total length of said antenna is substantially four-ninths of the length of a quarter-wave whip antenna operated at the same frequency.

* * * * *

UNITED STATES PATENT AND TRADEMARK OFFICE

CERTIFICATE OF CORRECTION

PATENT NO. : 4,161,737

DATED : July 17, 1979

INVENTOR(S) : Eugene A. Albright

It is certified that error appears in the above-identified patent and that said Letters Patent are hereby corrected as shown below:

Column 8, Claim 8, Line 27:

"Claim 1" should be --Claim 7--.

Signed and Sealed this

Ninth Day of October 1979

[SEAL]

*Attest:*

RUTH C. MASON
*Attesting Officer*

LUTRELLE F. PARKER
*Acting Commissioner of Patents and Trademarks*